US005921766A

United States Patent [19]

Döbbeling et al.

[11] Patent Number: 5,921,766

[45] Date of Patent: Jul. 13, 1999

[54] BURNER

[75] Inventors: Klaus Döbbeling, Windisch; Hans Peter Knöpfel, Besenbüren, both of Switzerland; Dieter Winkler, Lauchringen, Germany

[73] Assignee: ABB Research Ltd., Zurich, Switzerland

[21] Appl. No.: 08/852,548

[22] Filed: May 7, 1997

[30] Foreign Application Priority Data

May 17, 1996 [DE] Germany ..... 196 19 873

[51] Int. Cl.[6] ..... F24C 5/00

[52] U.S. Cl. ..... 431/173; 431/350; 431/354

[58] Field of Search ..... 431/350, 351, 431/354, 173, 284, 285, 177, 178, 159; 60/743

[56] References Cited

U.S. PATENT DOCUMENTS 4,781,030 11/1988 Hellat et al. .
5,274,993 1/1994 Keller .
5,307,634 5/1994 Hu .
5,340,306 8/1994 Keller et al. .
5,674,066 10/1997 Hausermann ..... 431/350

FOREIGN PATENT DOCUMENTS

0321809B1 6/1989 European Pat. Off. .
0610722A1 8/1994 European Pat. Off. .
1950077 8/1970 Germany .

*Primary Examiner*—James C. Yeung
*Attorney, Agent, or Firm*—Burns, Doane, Swecker & Mathis, L.L.P.

[57] ABSTRACT

In a burner of the double-cone design for burning liquid (12) and gaseous fuels (16), the at least two sectional cone bodies (1, 2) overlap at least partly, the overlap angle (δ) increasing in the direction of flow of the burner, and the distance between the fuel injectors (15) and the air-inlet plane (21) into the burner increasing simultaneously with the increase in the overlap angle (δ). As a result, the air-inlet plane (21) and the fuel-injection plane (22) no longer coincide. Improved premixing of the gaseous fuel (16) with the combustion air is achieved by the invention, which leads to lower NOx emissions of the burner and to lower thermal loading of the burner front.

2 Claims, 2 Drawing Sheets

BURNER

BACKGROUND OF THE INVENTION

1. Field of the Invention

The invention relates to the field of combustion technology. It relates to a burner of the double-cone design, in which gaseous fuel is fed to the combustion-air flow before it flows into the interior space of the burner.

2. Discussion of Background

U.S. Pat. No. 4,932,861 to Keller et al. discloses the basic construction of a burner of the double-cone design, to which the invention relates. This burner essentially comprises hollow sectional cone bodies mounted adjacent one another to defining a conical interior space that widens along a flow direction having tangential air-inlet slots and feeds for gaseous and liquid fuels. The center axes of the hollow sectional cone bodies are mutually laterally offset from one another longitudinal direction. A fuel nozzle is placed at the burner head in the conical interior space formed by the sectional cone bodies. Via gas injectors arranged along the inlet slots, the gaseous fuel is fed to the combustion-air flow prior to its inflow into the burner interior space. The fuel/air mixture therefore forms directly at the end of the tangential air-inlet slots. The air-inlet plane and the gas-inlet plane (perforation plane) therefore coincide in this known prior art.

The increase in swirl along the cone axis, in combination with the sudden widening in cross section at the burner outlet, leads to the formation of a backflow zone downstream of the burner outlet on the burner axis, which backflow zone stabilizes the flame. The ignition of the flame is not initiated until the stagnation point of the backflow zone.

In this known prior art, the last gas injectors along the air-inlet slots lie very close to the burner outlet and thus also lie in the vicinity of the flame. The length of the premix section is therefore very short at these points, so that the fuel which is injected from these last downstream nozzles is not able to mix very well with the inflowing combusting air. Local zones having a rich fuel/air mixture develop due to the poor premixing of the fuel with air, which rich fuel/air mixture leads to higher flame temperatures and thus also to higher NOx values. Furthermore, the additional loading becomes so high for the burner front in these regions that overheating occurs and the material has to be protected there by an expensive zirconium coating.

If it is desired to lengthen the premix section along the burner axis in order to reduce the NOx emissions, a complicated transition piece is necessary for this purpose between the burner and the following part, for example a tube arranged in front of the combustion chamber. The flow zone produced downstream by the burner results in problems with the axial velocity in the downstream part, either at the margin or in the center. This leads to flashbacks, so that the burner cannot be operated in this manner.

SUMMARY OF THE INVENTION

Accordingly, one object of the invention, in attempting to avoid all these disadvantages, is to provide a novel burner of the double-cone design which is of simple construction and thus inexpensive to produce and in which improved premixing of the gaseous fuel from the last gas-injection nozzles situated downstream with the combustion air takes place. The NOx emissions are reduced in comparison with the known prior art and the burner front is subjected to less thermal stress so that expensive special coatings of the burner front can be dispensed with.

According to the invention, this is achieved in that, in a burner of the double cone design as described the sectional cone bodies overlap, the overlap angle increasing in the direction of flow of the burner, and the distance between the fuel injectors and the air-inlet plane into the burner increasing simultaneously with the increase in the overlap angle. The fuel-injection plane and the air-inlet plane therefore no longer coincide, but the fuel-injection plane changes in position relative to the air-inlet plane along the burner.

The advantages of the invention consist, inter alia, in that the premixing of the gaseous fuel with the combustion air is improved in the region of the fuel injectors situated downstream on account of the enlarged premix section, so that the NOx emissions and the thermal loading of the burner front are reduced. The burner is distinguished by a more stable flame position and lower pulsations.

It is especially expedient if the overlap angle at the cone point is 0° and increases continuously up to the burner front, the maximum overlap angle being 90°.

If no overlap of the sectional cone bodies is provided at the cone point, a high axial velocity can continue to be achieved inside the burner on the axis of symmetry as in the known prior art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a burner composed of two sectional cone bodies, wherein.

DESCRIPTION OF THE PREFERRED EMBODIMENTS

Figure 1:
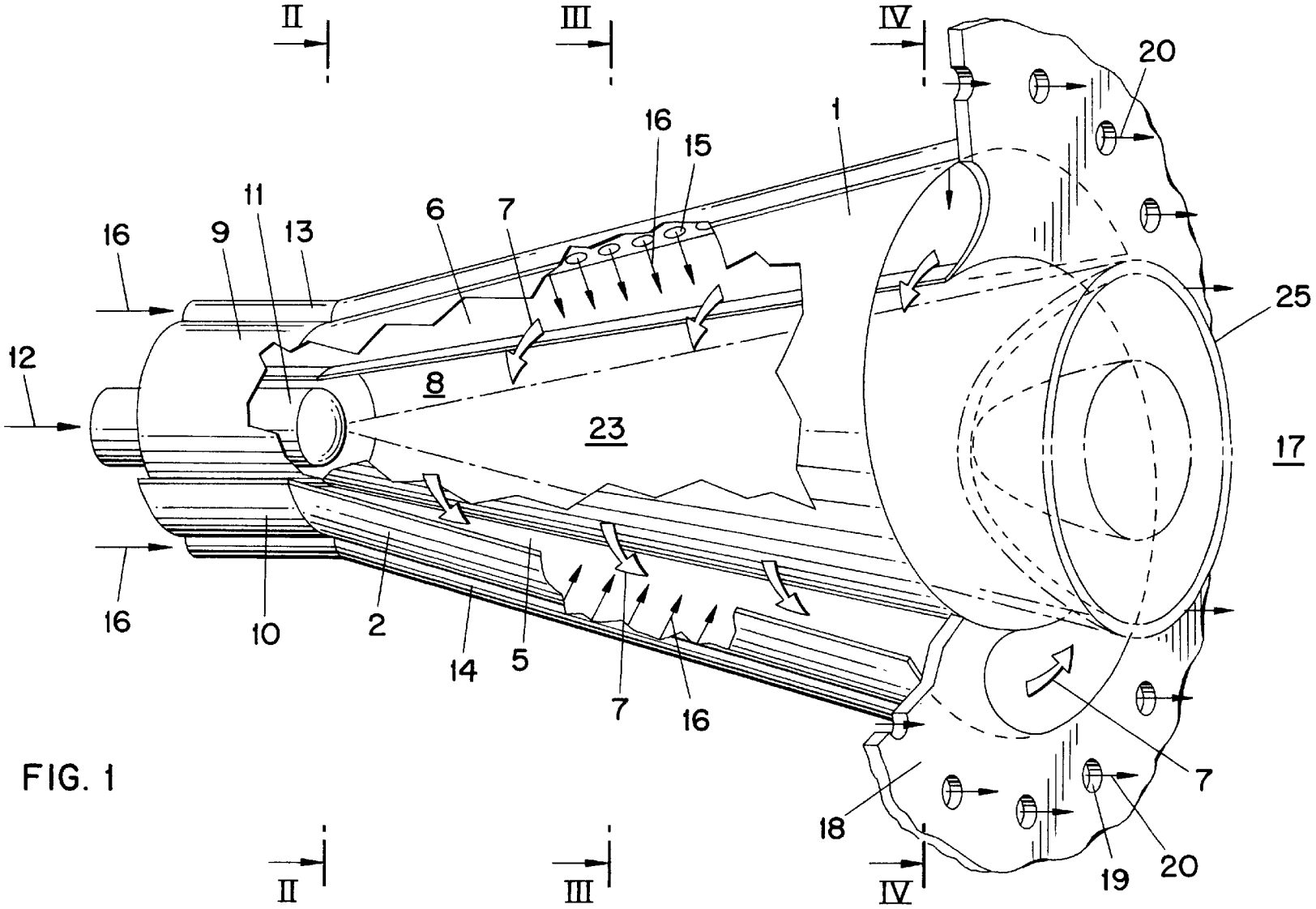
FIG. 1 shows a double-cone burner in a perspective representation.
Figure 2:
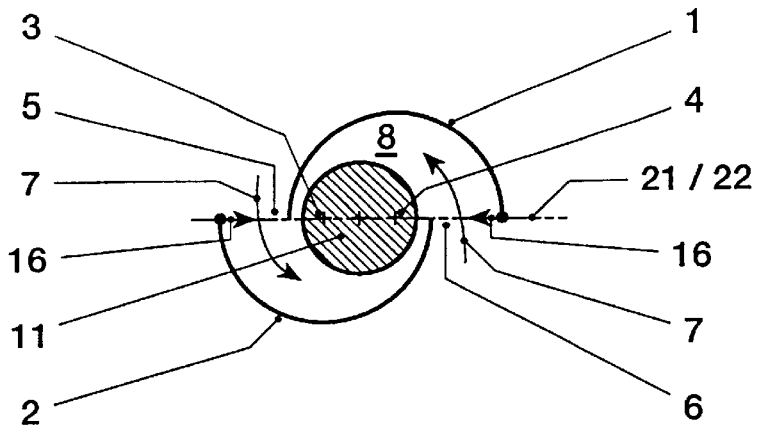
FIG. 2 shows a schematic cross section of the burner according to FIG. 1 along the plane II—II.
Figure 3:
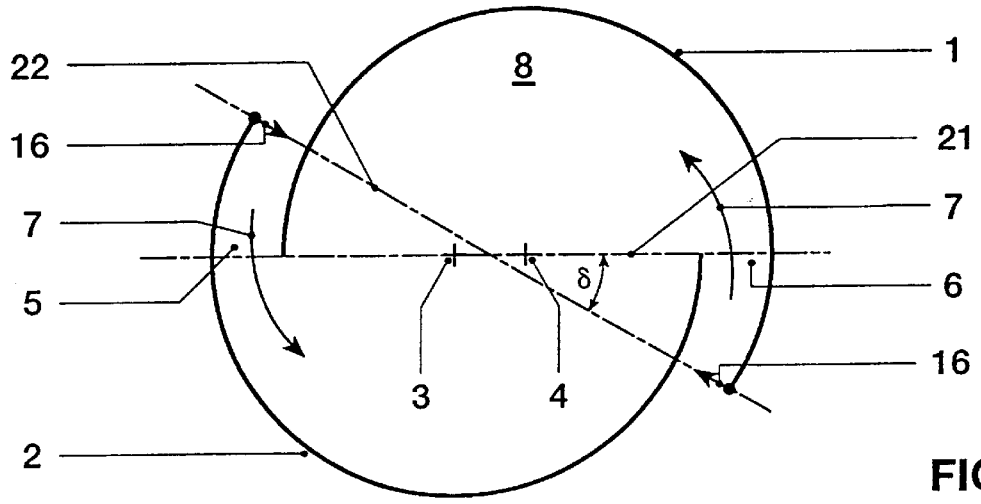
FIG. 3 shows a schematic cross section of the burner according to FIG. 1 along the plane III—III.
Figure 4:
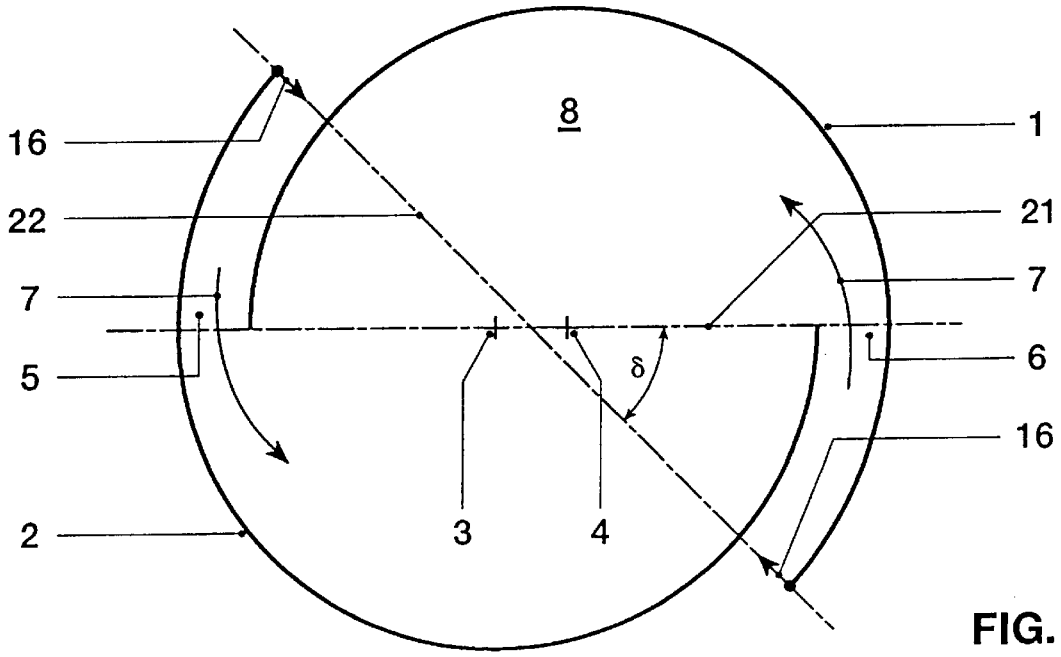
FIG. 4 shows a schematic cross section of the burner according to FIG. 1 along the plane IV—IV.

Referring now to the drawings, wherein like reference numerals designate identical or corresponding parts throughout the several views, only the elements essential for understanding the invention are shown, and the directions of flow of the various media are designated by arrows, FIG. 1 shows the burner according to the invention in a perspective representation. For the state of better comprehension, it is advantageous if the sections in FIGS. 2 to 4 are used at the same time as FIG. 1.

The burner according to FIG. 1 comprises two hollow sectional cone bodies 1, 2 mounted adjacent one another with their respective longitudinal center axes mutually offset. The mutual offset of the respective center axes 3, 4 of the sectional conical bodies 1, 2 provides on both sides, in mirror-image arrangement, tangential air-inlet slot 5, 6, through which air-inlet slots 5, 6 the combustion air 7 passes into the interior space 8 of the burner. The two sectional cone bodies 1, 2 each have a cylindrical initial part 9, 10 which likewise are laterally offset from one another, so that the tangential air-inlet slots 5, 6 are also present in this region. A nozzle 11 for atomizing the liquid fuel 12 is mounted in this cylindrical initial part 9, 10. The burner may also be constructed without the cylindrical initial parts 9, 10, so that it is of purely conical design. The fuel nozzle 11 is then directly mounted in the cone point. The two sectional cone bodies 1, 2 each have a fuel line 13, 14, which fuel lines are provided with openings 15 which represent fuel injectors. Gaseous fuel 16 is added by the fuel injectors 15 to the combustion air 7 flowing through the tangential air-inlet slots 5, 6.

On the combustion-chamber side 17, the burner has a front plate 18 serving as anchorage for the sectional cone bodies 1, 2 and having a plurality of bores 19 through which diluent or cooling air 20 can be fed, if need be, to the front part of the combustion space 17 or its wall.

If liquid fuel 12 is used to operate the burner, this liquid fuel 12 flows through the nozzle 11 and is injected in a conical spray having an acute angle into the interior space 17 of the burner, in the course of which a homogeneous fuel spray is produced. The conical liquid fuel profile 23 is enclosed by a rotating combustion-air flow 7 flowing in tangentially from the air inlet slots. The concentration of the liquid fuel 12 is continuously reduced in the axial direction by the intermixed combustion air 7. The optimum fuel concentration over the cross section is achieved only in the region of the vortex breakdown, i.e. in the region of the backflow zone 24. The ignition is effected at the tip of the backflow zone 24. Only at this point does a stable flame front 25 develop. The flame stabilization results from an increase in the swirl coefficient in the direction of flow along the cone axis. Flashback of the flame into the interior of the burner now no longer occurs.

If gaseous fuel 16 is burned, the formation of the mixture with the combustion air 7 takes place in the air-inlet slots 5, 6. According to the invention, the two sectional cone bodies 1, 2 overlap partly, the angle of overlap being measured as the angular difference between the edges of the overlapped burner bodies, which define the interior inlet plane 21 and the fuel injection plane 22. The overlap angle $\delta$ at the cone point is 0° (i.e. there is no overlap there) and $\delta$ then increases continuously in the direction of flow up to the burner outlet, that is, up to the front plate 18. 90° may be specified as the maximum overlap angle $\delta$.

If the overlap angle is 0° at the cone point or at the cylindrical initial part 9, 10 of the two sectional cone bodies 1, 2, that is, if the two sectional cone bodies 1, 2 do not overlap in this region, this has the advantage that a high axial velocity is thereby also achieved inside the burner on the axis of symmetry.

The air flow 7 is ducted by the overlapped walls of the sectional cone bodies 1, 2.

The fuel injectors 15 are shifted further upstream to the same extent as the overlap angle 6 changes. Thus the air-inlet plane 21 and the fuel-injection plane 22 no longer coincide. The fuel-injection plane 22 changes its position relative to the air-inlet plane 21 along the double-cone burner in the direction of the burner front in such a way that ever larger premix sections from the respective fuel injection of the gaseous fuel 16 up to the air-inlet plane 21 are achieved.

Homogeneous mixing of the gaseous fuel 16 and the combustion air 7 is thereby achieved, which leads to lower flame temperatures and thus to lower NOx emissions. These lower flame temperatures in the region of the burner outlet also reduce the thermal loads for the material at the burner front and dispense with the need for an otherwise necessary zirconium coating of the material.

Furthermore, the flame has a more stable position in comparison with the prior art known hitherto, in which the sectional cone bodies 1, 2 do not overlap and the fuel-injection plane 22 corresponds to the air-inlet plane 21. An additional advantage obtained is that the burner according to the invention is also less susceptible to pulsations. It is of very simple design (e.g. without complicated transition pieces for lengthening the premix section) and is therefore inexpensive to produce.

The invention is of course not restricted to the exemplary embodiment just described. The solution according to the invention may likewise also be used for burners which comprise more than two sectional cone bodies, e.g. for so-called four-slot burners.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for burning liquid and gaseous fuels, comprising at least two hollow sectional cone bodies mounted adjacent one another to form a burner body enclosing a conical interior space, longitudinal center axes of the sectional cone bodies being mutually laterally spaced to form longitudinally extending air-inlet slots, the air-inlet slots defining at least one air-inlet plane into the burner, the hollow sectional cone bodies widening in a direction of flow, a fuel nozzle for liquid fuel mounted at a burner head in the conical interior space, and feeds for gaseous fuel provided adjacent the air-inlet slots, the feeds having fuel injectors to inject fuel into the air-inlet slots and defining at least one fuel-injection plane, wherein the sectional cone bodies overlap at least partly, an overlap angle increasing in the direction of flow of the burner, and a distance between the fuel injectors and the air-inlet plane into the burner increasing simultaneously with the increase in the overlap angle.

2. The burner as claimed in claim 1, wherein the overlap angle at the the burner head is 0° and increases continuously downstream up to the burner front, wherein a maximum overlap angle is 90°.

* * * * *